US005133450A

United States Patent [19]

Rademacher

[11] Patent Number: 5,133,450

[45] Date of Patent: Jul. 28, 1992

[54] PRESSURE FIT CARD

[76] Inventor: Robert H. Rademacher, 153 Locust Ct., Flemington, N.J. 08822

[21] Appl. No.: 759,602

[22] Filed: Aug. 5, 1991

Related U.S. Application Data

[63] Continuation of Ser. No. 594,041, Oct. 9, 1990, abandoned.

[51] Int. Cl.[5] ..... B65D 5/50

[52] U.S. Cl. ..... 206/44 B; 206/455; 206/456; 40/156

[58] Field of Search ..... 206/44 B, 456, 455, 206/449; 40/661, 152, 642, 156

[56] References Cited

U.S. PATENT DOCUMENTS

| | | | |
|---|---|---|---|
| 3,988,846 | 11/1976 | Kuhling | 40/152.1 |
| 4,441,268 | 4/1984 | Scott | 40/152.1 |
| 4,819,804 | 4/1989 | Levy | 206/456 |
| 4,829,691 | 5/1989 | Manjos et al. | 40/661 |

FOREIGN PATENT DOCUMENTS

| | | | |
|---|---|---|---|
| 2333766 | 1/1975 | Fed. Rep. of Germany | 40/661 |

*Primary Examiner*—Paul T. Sewell
*Assistant Examiner*—Thomas P. Hilliard
*Attorney, Agent, or Firm*—William T. Hough

[57] ABSTRACT

A snap-type holder is described for collecting baseball, basketball, football, or other type sports cards. The holder includes a clear plastic bottom plate having a recess just slightly larger than the card to be placed therein, so as to correlate with card manufacturing tolerances. A clear plastic top plate snaps tight over the bottom plate by a pressure fit resulting from clearance specifications of 0.001–0.002" so as to seal the card against moisture, dirt and ambient air, and so as to secure the holder if it were accidentally dropped, thereby protecting the sports card from damage. A notch is provided in the holder to allow separation of the top and bottom plates when it is desired to remove the card for replacement.

9 Claims, 3 Drawing Sheets

PRESSURE FIT CARD

This application is a continuation of Ser. No. 07/594,041, filed Oct. 9, 1990, which is now abandoned.

FIELD OF THE INVENTION

This invention relates to the collecting of memorabilia, and, more particularly, to a snap-tight holder for the collection of baseball, basketball, football, and other type sports cards.

BACKGROUND OF THE INVENTION

As is well known and understood, one of the more significant investment strategies in the past several years has been the collecting of various types of memorabilia for later resale. As is also well known and understood, one of the more successful of these collection-type strategies has been the collecting of sports cards—and, particularly baseball cards. In fact, almost weekly, one can find an exhibition of sports cards and memorabilia at various showplaces, often times attended by a sports personality signing autographs. At these shows, one can also typically find several sellers of sports-type cards, often times displaying them within soft plastic sheets maintained in loose-leaf books, or packed within soft plastic envelopes stored one behind another in various box enclosures. As is well known to the serious collector, these sports-type cards—and, particularly, baseball cards—have significantly appreciated in value, to the extent the certain ones sell for upwards of $10,000, and even more. It goes without saying, therefore, that for the optimum protection of these cards, a person must concern himself, or herself, with limiting their exposure to moisture, dust and ambient air conditions. At the same time, such a person must also take whatever steps are possible to protect the sports-card against physical damage. As with the true collector, in addition, the protection afforded must also be such so as to allow the person to look at, and enjoy the pleasure of, the sports card, as its pleasing appearance is almost as important as the appreciation that it is hoped for will present itself over a period of years.

SUMMARY OF THE INVENTION

As will become clear hereinafter, the sports card holder of the present invention is a snap-type holder including a clear plastic bottom plate having a recess just slightly larger than the card to be place therein, so as to correlate with card manufacturing tolerances. The sports-card holder also includes a clear plastic top plate which snaps over the bottom plate by a pressure fit resulting from clearance specifications of about 0.001–0.002"—so as to seal the card against moisture, dirt and ambient air, and so as to secure the holder if it were accidentally dropped. In a preferred embodiment of the invention, A clear-plastic holder of polystyrene was employed, so as to permit viewing of the baseball card from both front and back sides, and to protect the sports card from damage by virtue of a pressure fit. In accordance with the invention, a notch is provided in the holder to allow separation of the top and the bottom plates when it is desired to remove the card for replacement or sale. So as to facilitate the alignment of the top and bottom plate, a "nib" is provided, which will be seen to follow from its serving as the flow gate in the plastic entering a mold from which the top and bottom plates are constructed. As will be seen, the snap-tight holder which results is attractive in appearance, exceedingly quick, easy and simple to take apart and put together, and provides a high degree of protection to the card within, until such time as it is desired to pry-apart the two plates when removing the card.

BRIEF DESCRIPTION OF THE DRAWINGS

These and other features of the invention will be more clearly understood from a consideration of the following description, taken in connection with the accompanying drawings in which.

Figure 1:
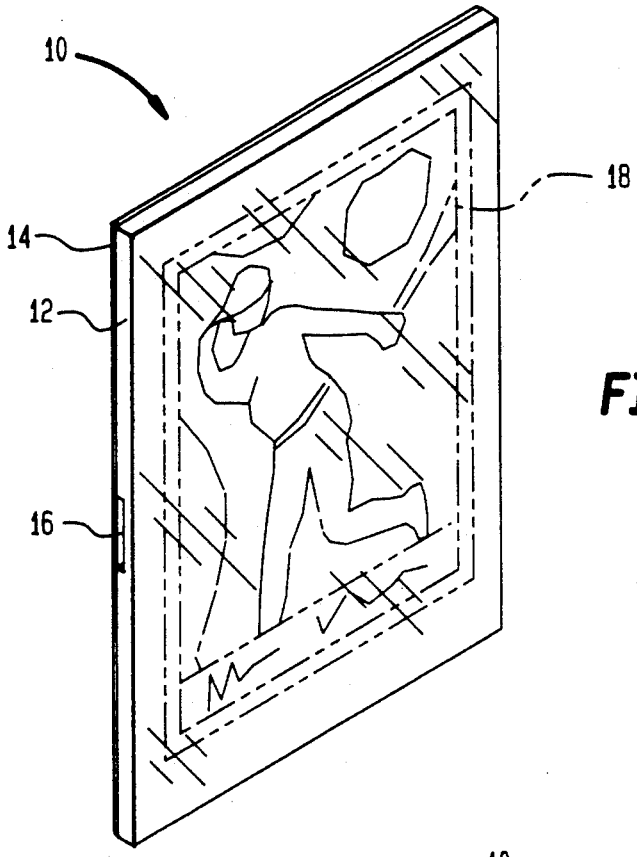
FIG. 1 is a front perspective view of a snap-type card holder constructed in accordance with the invention as it would appear with a baseball-type sports card emplaced therein.

FIGS. *3a–3c* are front, top and side views respectively of the bottom plate of the snap-tight card holder embodying the invention and;

FIGS. *4a–4c* are front, top and side views of the top plate of the holder of the invention.

DETAILED DESCRIPTION OF THE DRAWING

Figure 2:
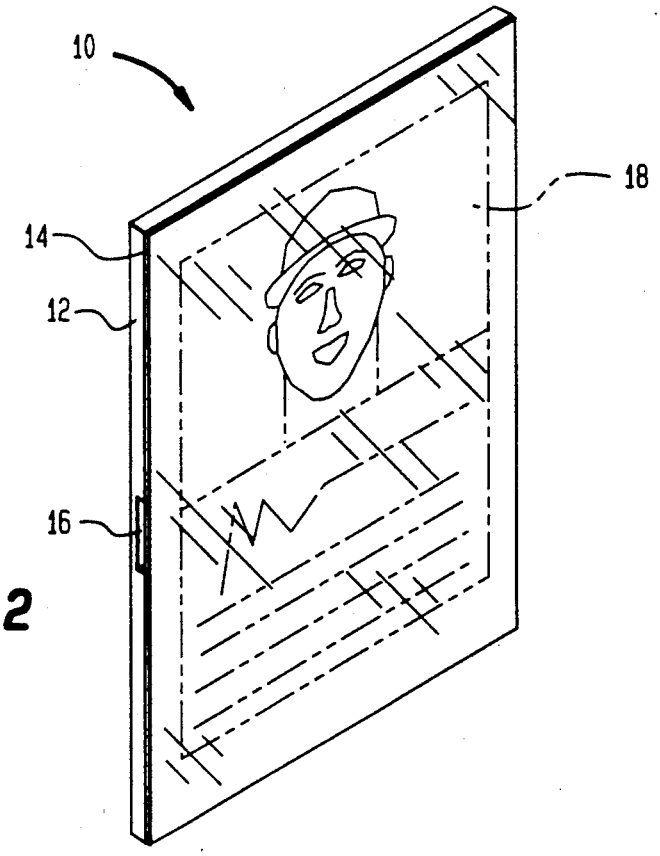
FIG. 2 is a rear perspective view of the snap-tight card holder of FIG. 1.

Referring to FIGS. 1 and 2, the snap-type card holder 10 incorporates a clear plastic top plate 12 and a similarly clear bottom plate 14 preferably formed of polystyrene and manufactured, for example, in a four-cavity mold (two top plates, two bottom plates). As will be seen, a pair of slots 16 are provided (although the holder can be made with just a single slot), one on either side, to facilitate the separation of the top plate 12 from the bottom plate 14 by a "pry-action" (as by the insertion of a coin and subsequent twisting) when it is desired to insert the sports card 18 into an enclosed recess 20, or to remove it therefrom as desired. In accordance with the invention, the recess 20 is constructed just slightly larger than the sports card to be inserted, so as to correlate with card manufacturing tolerances, which, typically, are ±0.050". Thus, for most sports cards manufactured from 1957 to the present, having dimensions specified to be 2½"×3½", the recess 20, according to the invention, may be constructed of a width 21 2.550" and a height 23 of 3.570". To correctly align with the top and bottom plates after the card 18 is incorporated in the recess 20, a pair of nibs 22 are employed—one on each of the plates 12, 14—which may be the input point at which the plastic flows during the molding process. As will be appreciated, the front of the clear plastic card holder might then display an "action" shot of the sports personality, while the back of the holder might display statistical information about the personality, including his, or her records, and a candid photograph of the player in a relaxed moment.

Referring to FIGS. *3a–3c*, all three figures illustrate the bottom plate of FIGS. 1 and 2 identified therein as bottom plate 14, the bottom plate of FIGS. *3a–3c* being shown as including the recess 20 surrounded by a shelf 24 and a lip 26, all being orthagonal in nature, and with the lip 26 having rounded edges 28. As will be seen, the shelf 24 has one side 30 of a width dimension 100 greater than a second width dimension 101 at the side 32, so as to permit the insertion on the card holder of any labelling information that might be adhesively secured, for example. While applicant does not wish to be limited to any particular set of values, the following dimensions have proved useful in a construction of the preferred embodiment of the invention:

| | |
|---|---|
| Dimension 100 | .436 inch |
| Dimension 101 | .171 inch |
| Dimension 102 | .500 inch |
| Dimension 103 | 3.535 inch |
| Dimension 104 | .250 inch |
| Dimension 105 | 2.525 inch |
| Dimension 106 | .064 inch |
| Dimension 107 | 4.142 inch |
| Dimension 108 | .074 inch |
| Dimension 109 | 4.280 inch |
| Dimension 110 | .060 inch |
| Dimension 111 | .022 inch |
| Dimension 112 | .100 inch |
| Dimension 113 | .065 inch |
| Dimension 114 | 2.895 inch |
| Dimension 115 | 3.025 inch |
| Radius 116 | .015 inch |
| Angle 117 | 5° |

(In this description, it is to be understood that the labeling information to be included, if desired, at the section 30, may either be affixed to display that information upwardly through the top plate 12, or downwardly through the bottom plate 14.)

Figure 3B:
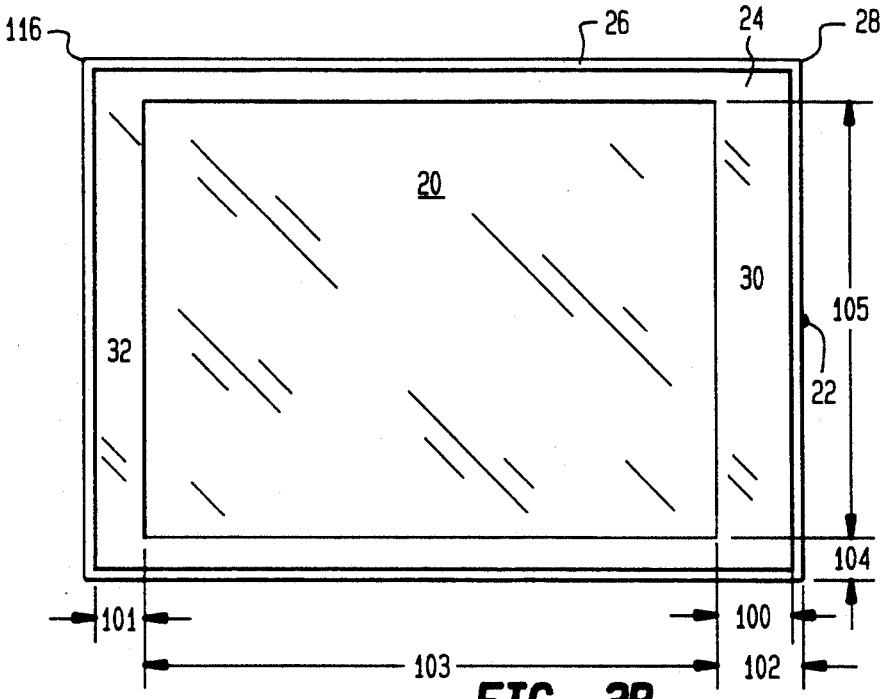
Figure 3A:
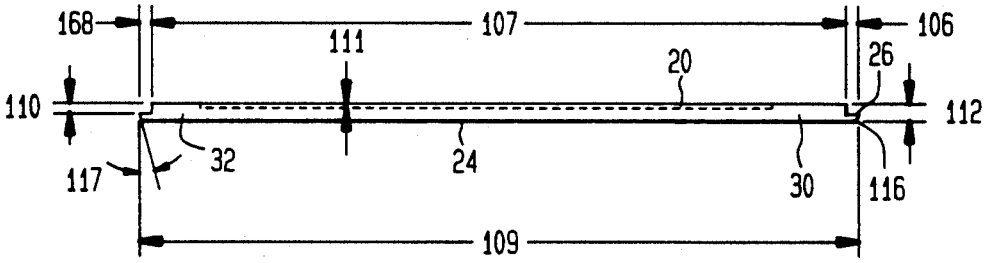
Figure 3C:
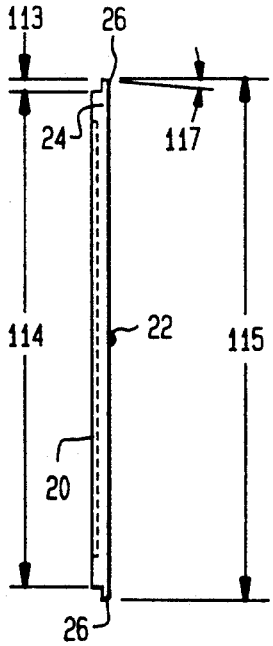
Figure 4B:
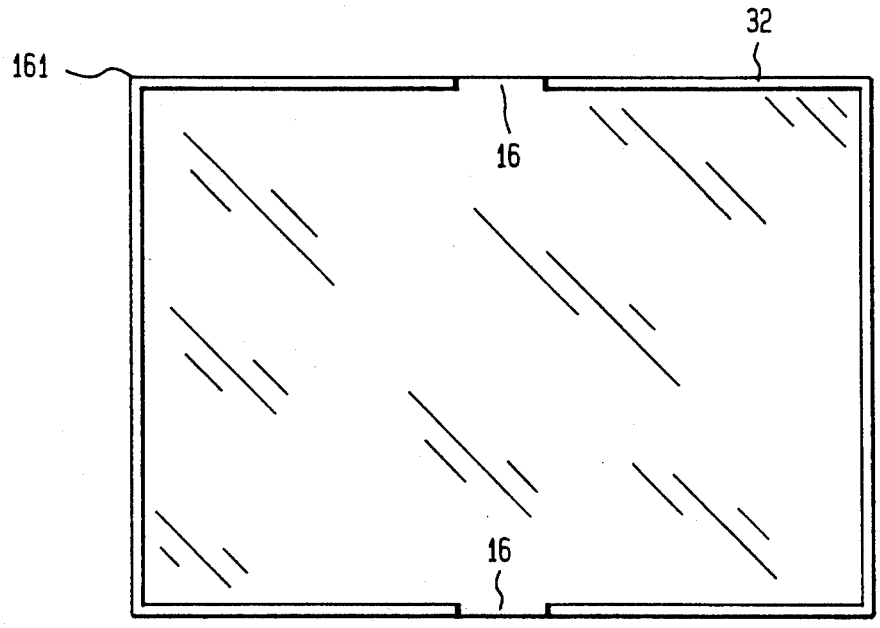
Figure 4A:
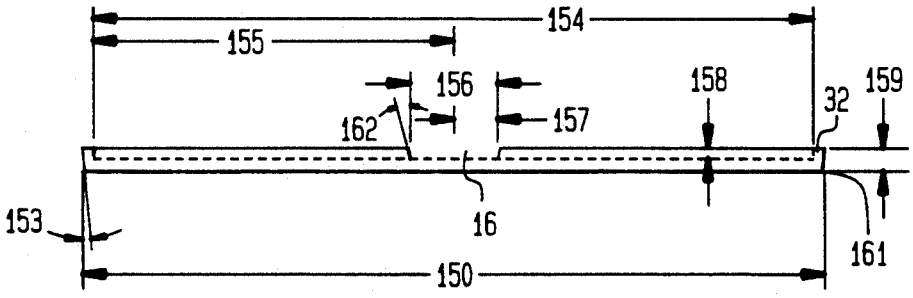
Figure 4C:
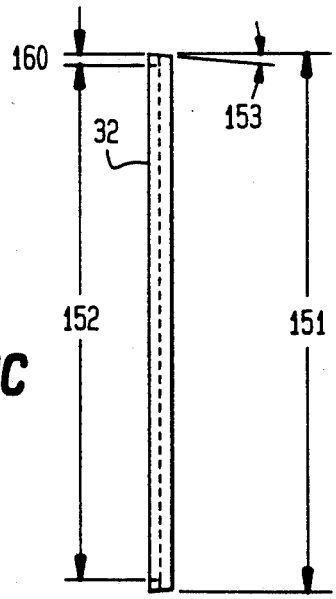

Referring now to FIGS. 4a–4c, the top plate 12 there shown illustrates the slots 16 cut into a surrounding wall 32 which traverses, and forms, the outer edge of the top plate 12. Such wall 32 is also orthagonal, and is selected of a height dimension 150 which is exactly equal to the height dimension 109 of the bottom plate 14 (FIG. 3a). At the same time, the wall 32 is selected of a width dimension 151 which is exactly the same as the width dimension 115 of the bottom plate 14 (FIG. 3c). At the same time, in order for the top plate 12 to pressure-fit over the bottom plate 14, the height dimension 152 of the top plate 12 is just slightly greater than the height dimension 114 of the bottom plate 14 (FIG. 4c as compared to FIG. 3c), and of the order of approximately 0.001–0.002 inch. To similarly effectuate this, the angle 153 of FIG. 4c of the top plate 12 is slightly larger than the angle 115 of FIG. 3c, 15° as compared to 5°. Pushing the top plate 12 and the bottom plate 14 together then produces a very close and tight fit, to the extent that an accidental dropping of the assembled card holder onto the floor would not dislodge the two plates. In order to separate them, a coin, or similar such pry must be inserted into the slot 16 to afford the needed force.

While applicant, again, does not wish to be limited to any particular set of values, the following have proven useful for a top plate 12 when the bottom plate 14 is of the dimensions set forth above:

| | |
|---|---|
| Dimension 150 | 4.280 inch |
| Dimension 151 | 3.025 inch |
| Dimension 152 | 2.897 inch |
| Dimension 154 | 4.140 inch |
| Dimension 155 | 2.070 inch |
| Dimension 156 | .500 inch |
| Dimension 157 | .250 inch |
| Dimension 158 | .060 inch |
| Dimension 159 | .130 inch |
| Dimension 160 | .064 inch |
| Radius 161 | .015 inch |
| Angle 153 | 15° |
| Angle 162 | 15° |

As will be apparent from the foregoing description, the top plate 12 and bottom plate 14, when pressed together, form a unitary construction for the cardholder 10 where all external surfaces line up collinearly. By having the top plate 12 overlap the bottom plate 14 by 0.001" on all sides, and with an angular difference between the top plate and bottom plate walls of approximately 10°, the plates 12, 14, become tightly secured together. Such pressure-fit prevents any moisture, dust or ambient air from entering into the recess 20 where the sports-type card is located, and causing damage to it over the course of time. The pressure fit similarly will be seen to prevent mechanical or physical damage to the card upon dropping of the holder, as the relative dimensionings between the plates 12, 14, keep the holder as a single unit, without any separation. By using the clear plastic polystyrene, for example, the holder presents a pleasing appearance, so that the display and/or writings of the card can be viewed from outside the holder, while the holder is held, or otherwise positioned. As will be seen, the only access to the recess 20 which can then result is by a prying-open of the slots 16 to separate the two plates.

While there has been described what is considered to be a preferred embodiment of the present invention, it will be readily appreciated by those skilled in the art that modifications can be made without departing from the scope of the teachings herein of providing a pressure fit between the top and bottom plates in securing the holder against accidental dropping, and against moisture, dirt or ambient air. For at least such reason, therefore resort should be had to the claims appended hereto for a true understanding of the invention.

I claim:

1. A sports card holder comprising in combination: a first upper plate having a first predetermined thickness formed by first circumscribing walls and a second lower plate having a second predetermined thickness formed by second circumscribing walls; the first upper plate having opposite first upper and lower surfaces, and the second lower plate having opposite second upper and lower surfaces; said first lower surface having a first predetermined surface area and first shape formed by said first circumscribing walls, and said second upper surface having a second predetermined surface area formed by said second circumscribing walls; said first predetermined surface area and said first shape being substantially the same as said second predetermined surface area and second shape, such that one of said first and second predetermined surface areas is conformable and matchable with the other of said first and second predetermined surface areas in face-to-face relationship; at-least one of said first lower surface and said second upper surface including a card-receiving recess therein of a shape which receives and retains therein a card; each of said first upper plate and said second lower plate being sufficiently transparent as to constitute see-through plates through which opposite faces of a card are discernibly viewable when mounted within said card-receiving recess; one of said first lower surface at said first circumscribing walls and said second upper surface at said second circumscribing walls, forming a first inwardly-facing step, and a remaining other one of said first lower surface and said second upper surface forming a second outwardly-facing step of a shape and positioned to be sealably overlapped by and to mesh with said first inwardly-facing step in a snapping pressure-fit relationship thereby intermittently securable together of the first upper plate and the second lower plate sufficiently to seal said card recess when said first predetermined surface area is conformed with and in a meshed, matched state with said second predetermined surface area in face-to-face relationship.

2. The sports card holder of claim 1, including an opening means for enabling at-least partial insertion of a finger between said first upper plate and said second lower plate sufficiently to pry-apart the first upper and second lower plate when intermittently secured together in said matched state.

3. The sports card holder of claim 2, in which said first upper plate includes said first inwardly-facing step, and in which said second lower plate includes said second outwardly-facing step, and said card-receiving recess being formed in said second upper surface.

4. The sports card holder of claim 1, in which said first upper plate includes said first inwardly-facing step, and in which said second lower plate includes said second outwardly-facing step, and said card-receiving recess being formed in said second upper surface.

5. The sports card holder of claim 2, in which said opening means at said second outwardly-facing step includes a lower outwardly-extending flange that extends beneath said first circumscribing walls, and in which said first circumscribing wall includes a lower edge and said opening means comprises a through-space slot in said lower edge in juxtaposition to said outwardly-extending flange when in said snapping pressure-fit relationship.

6. The sports card holder of claim 5, in which said first upper plate and second lower plate are each plastic.

7. The sports card holder of claim 1, in which said first upper plate and second lower plate are each plastic.

8. The sports card holder of claim 1, in which said first lower surface having said first predetermined surface area and first shape and said second upper surface having said second predetermined surface area are of substantially a common and matching orthogonal shapes.

9. The sports card holder of claim 5, in which said first inwardly-facing step includes a first upright step-wall and in which said second outwardly-facing step includes a second upright step-wall extending from a lower apex-point upwardly to said opposite said upper surface at an angle of about 10 degrees relative to an imaginary linear line parallel with said first upright step-wall.

* * * * *